United States Patent [19]

Sando et al.

[11] 4,142,854

[45] Mar. 6, 1979

[54] CONTINUOUS LIQUID PROCESSING OF CLOTH IN A HIGH PRESSURE STEAMER

[75] Inventors: Yoshikazu Sando; Hiroshi Ishidoshiro, both of Wakayama, Japan

[73] Assignee: Sando Iron Works, Co., Ltd., Wakayama, Japan

[21] Appl. No.: 776,911

[22] Filed: Mar. 11, 1977

[30] Foreign Application Priority Data

Mar. 18, 1976 [JP] Japan ..... 51-29526
Nov. 19, 1976 [JP] Japan ..... 51-139260

[51] Int. Cl.[2] ..... D06B 23/18
[52] U.S. Cl. ..... 8/149.1; 68/5 E
[58] Field of Search ..... 8/149.1; 68/5 D, 5 E

[56] References Cited

U.S. PATENT DOCUMENTS 2,532,471 12/1950 Wedler ..... 8/149.1 X
3,986,831 10/1976 von der Eltz et al. ..... 68/5 E X

FOREIGN PATENT DOCUMENTS 2228440 1/1974 Fed. Rep. of Germany ..... 68/5 E

*Primary Examiner*—Philip R. Coe
*Attorney, Agent, or Firm*—Toren, McGeady and Stanger

[57] ABSTRACT

A continuous liquid processing of cloth in a high pressure steamer is characterized by spraying a processing liquid, such as liquid dyestuff, etc. in a suitable amount from a group of nozzles provided within a high pressure steamer vessel onto one or both surfaces of the cloth to be treated, such as round drum cloth, supplied continuously into the high pressure steamer vessel, so that the processing liquid is sufficiently and uniformly impregnated into the cloth being treated within said vessel, and, further conducting high humidity and high temperature treatment of the cloth.

3 Claims, 6 Drawing Figures

CONTINUOUS LIQUID PROCESSING OF CLOTH IN A HIGH PRESSURE STEAMER

BACKGROUND OF THE INVENTION:

The present invention relates to a method of impregnating cloth to be treated, such as round drum cloth, etc., with a processing liquid, such as dyestuff liquid, etc. in a high pressure steamer vessel in a sufficient and uniform manner, conducting high humidity and high temperature treatment of the cloth.

In a similar conventional processing method when the cloth being processed is round drum cloth, etc., stitched or woven in a tubular shape it is treated with a processing liquid, such as dyestuff liquid etc., by dipping the cloth in liquid stored in a processing tank for impregnating it with the with processing liquid, then after adjusting the amount of the processing liquid impregnated into the cloth to a prescribed amount by squeezing the cloth with squeezing rolls, the cloth is heat treated, or the cloth is processed in a liquid tank located outside of a high pressure steamer, and then is introduced into the high pressure steamer vessel in a high humidity and high temperature state for conducting the liquid processing.

Therefore, the conventional method has shortcomings such that the round drum cloth being processed is impregnated with dyestuff liquid and the cloth is passed through squeezing rolls causing crease marks in the hem of the cloth to be processed at high pressure in a steamer thus dyeing specks are formed in linear shape. Further, since the processing liquid, such as dyestuff liquid etc., sticks to surfaces of the squeezing rolls in a high pressure steamer, which is made nowadays on a large scale, and stains the roll surfaces, requiring cleaning the roll surfaces frequently or every time the processing liquid is replaced, thus consuming time and man power with a lowering of productivity.

While an apparatus has been proposed in which the processing liquid is applied to the cloth after it has passed through rubber sealing rolls of a high pressure steamer sealing mechanism for eliminating the above mentioned shortcoming, in such apparatus the processing liquid tank is located at a position within the high pressure steamer vessel interiorly of the pressure contacting part of the sealing rubber rolls, therefore, even if the staining of the sealing rolls surfaces can be avoided, there is the necessity to clean the inside of the liquid tank every time the processing liquid is replaced, further the processing liquid tank is provided within the steamer vessel and can not be viewed from the outside thus having such inconvenience that the degree of stain in the tank can only be estimated, and sometimes results in incomplete cleaning.

SUMMARY OF THE INVENTION:

The present invention provides a method of continuous liquid processing of a cloth which eliminates the shortcomings of the conventional methods and impregnates a cloth with a prescribed amount of dyestuff liquid or other processing liquid within a high pressure steamer vessel, for conducting high degree of processing such as dyeing, etc.

In a continuous liquid processing method according to the present invention, a cloth to be processed is introduced into a high pressure steamer vessel having a cloth inlet and a cloth outlet and operating under high humidity and high temperature conditions processing liquid is sprayed out of a coating mechanism located near the inlet of the vesssel and coats the cloth with a desired amount of the processing liquids and the cloth is then transported by a number of guide rolls in a continuous manner by adjustment of transporting speed. The processing liquid in the vaporized state fills the inside of the cover which encloses the coating mechanism so that the surface of the cloth passes through the cover is coated and impregnated with a prescribed amount of processing liquid in a uniform manner, while an appropriate amount of tension is applied to said cloth being transported through the vessel.

In the continuous liquid processing method according to the present invention a cloth to be processed is passed through a sealing mechanism into a high pressure steamer vessel and a processing liquid coating mechanism is provided near the inlet to the vessel, further, downstream of the coating mechanism is a number of guide rolls for conducting the cloth in a zigzag path between the coating mechanism and the vessel. Dancer rolls give an appropriate amount of tension to the cloth as it is transported. A cover encloses the processing liquid coating mechanism and the cloth passes downwardly through it. Within the cover, spray nozzles blow the processing liquid onto both surfaces of the cloth with the nozzles arranged in parallel multi-layers. A processing liquid receiving and storage tank is provided at a bottom of cover, so that the processing liquid in the tank can be recycled to the spray nozzles by the driving force of a pump, etc.

In another arrangement of the continuous liquid processing method of the present invention, a pair of gap rolls are provided inside the steamer with a gap maintained between them and a pre-heating chamber is formed between the steamer vessel inlet and the gap rolls. Reducing exhaust pipes are provided in the preheating chamber. Liquid spray nozzles are provided in parallel multi-layers within the pre-heating chamber.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

FIG. 1 is a vertical cross-sectional view of the interior of a liquid processing apparatus in accordance with the present invention.

FIGS. 2(*a*), (*b*) and (*c*) are a side elevation, a plan, and a front elevation, respectively, illustrating on an enlarged scale an important part of the apparatus in FIG. 1.

Figure 1:
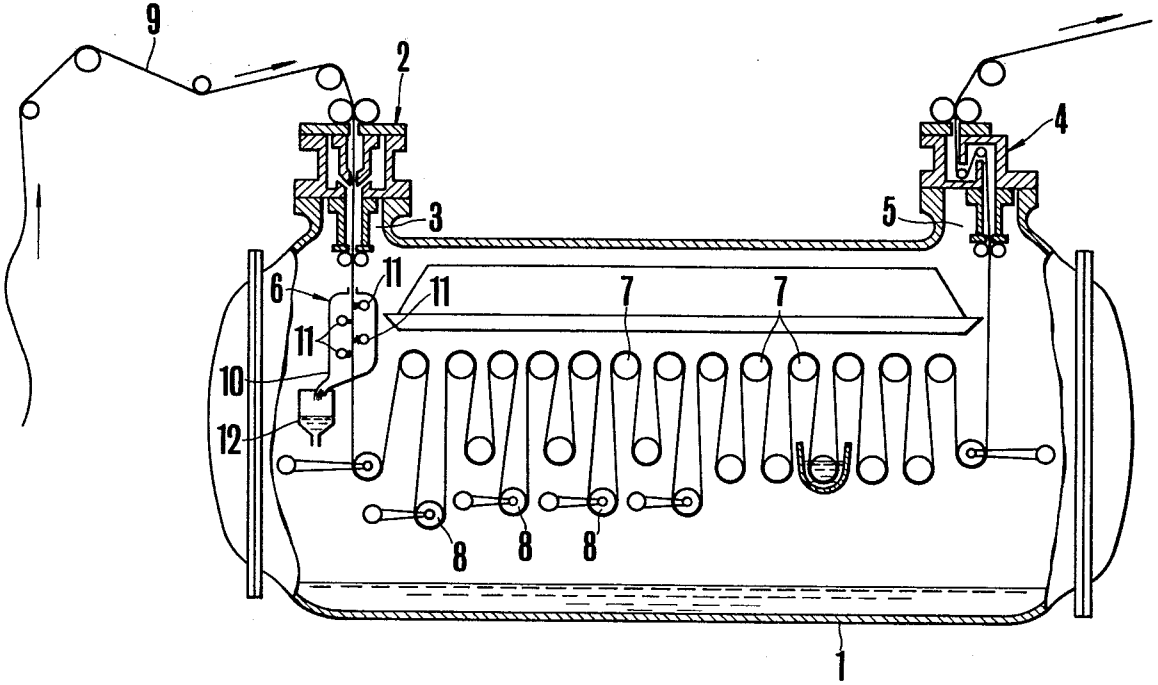

DESCRIPTION OF THE PREFERRED EMBODIMENTS:

In FIG. 1 a high pressure steamer vessel (1) is shown in which a high pressure humid temperature up to about 5 kg/cm$^2$, 160° C., is maintained and an inlet sealing mechanism (2) is provided at an inlet (3) for cloth to be processed in the steamer vessel (1) while an outlet sealing mechanism (4) is provided at a cloth outlet (5) from the (1). A coating mechanism (6) for a processing liquid such as a dyestuff liquid, etc. is provided near the cloth inlet (3) within the steamer vessel (1), and a number of guide rolls (7) are provided for transporting the cloth in a zigzag manner between the processing liquid coating mechanism (6) and the cloth outlet (5) from the steamer vessel (1). Further, a plurality of dancer rolls (8) spaced from and in parallel with the guide rolls are positioned to give an appropriate amount of tension to the cloth traveling over the rolls.

Figure 2:
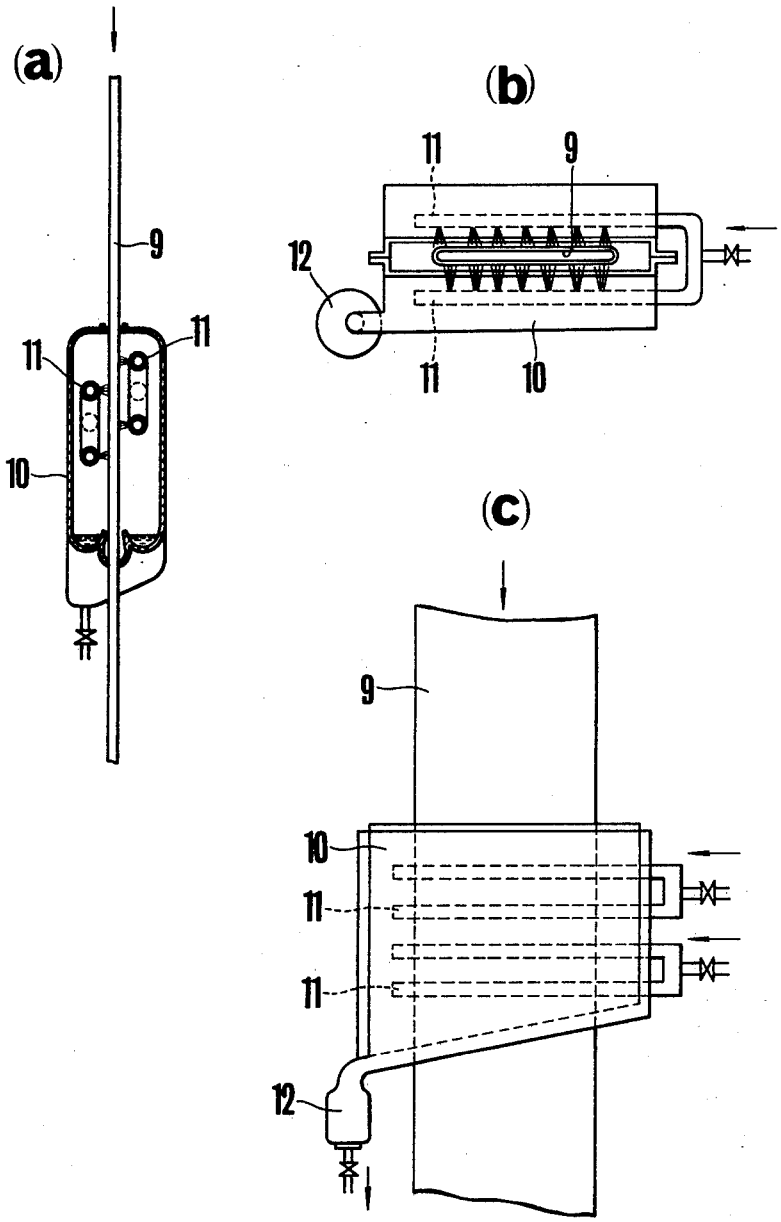

FIGS. 2(*a*), (*b*) and (*c*) are a side elevation, a plan and a front elevation, respectively, disclosing in an enlarged manner, details of said processing liquid coating mechanism 6 which constitutes the present invention.

In each of these FIGS., processing liquid spray nozzles (11) directed toward both surfaces of a cloth (9) to be processed are provided in parallel multi-layers within a cover (10) through which the cloth (9) passes downwardly, and a processing liquid receiving and storage tank (12) is located at the bottom of the cover (10) so that the processing liquid stored in the tank (12) is fed to the spray nozzles (11) by a driving mechanism such as a pump, etc. (not shown in the drawing) for re-using the liquid.

Since a cloth to be processed is coated and impregnated with the processing liquid by the spray system as shown within example, there is the advantage that the cloth can be continuously coated and impregnated with a desired amount of processing liquid by adjusting both the amount of the processing liquid sprayed from the nozzles and the transporting speed of the cloth.

Further, there is the special feature that the inside of the cover (10) is filled with vaporized processing liquid by providing the nozzles in a great number and by enclosing the nozzles with the cover (10), thus the surface of the cloth passing through said cover (10) can be impregnated with a uniform and prescribed amount of processing liquid.

Therefore, the present invention has the advantage that a cloth being processed can have a desired amount of processing liquid impregnated therein without providing squeezing rolls, eliminating processing specks by crease marks which take place frequently in a conventional processing operations, thus uniform processing of cloth such, as round drum cloth, etc., can be done.

Figure 3:
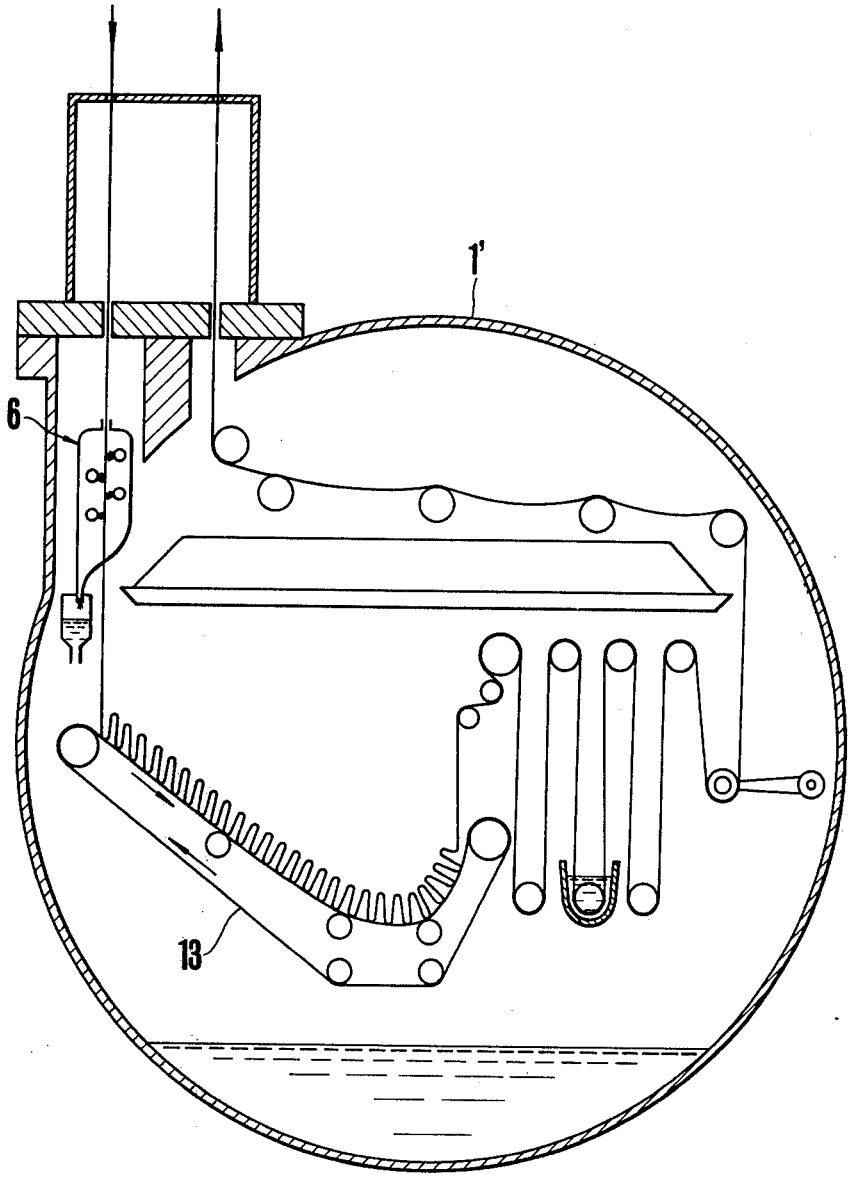
FIG. 3 is a cross-sectional view showing in cross section part of another liquid processing apparatus embodying the present invention.

Next, another embodiment of the present invention is shown in FIG. 3. A slanted endless conveyor (13) is provided within a steamer vessel (1'), and a cloth to be impregnated with a prescribed amount of processing liquid (dyestuff liquid, etc.) is conveyed through a processing liquid coating mechanism (6) surrounded by a cover in which humidity-heat processing is carried out while the timing of the operation is suitably adjusted by the conveyor (13), so that the processing liquid (dyestuff, etc.) is completely fixed. However, since the structure of the steamer vessel (1') is not a part of the present invention, the detailed explanation thereof will be omitted. A roller conveyor or conveyors can be used in place of the endless conveyor.

In this example, since the cloth is coated and impregnated with processing liquid by a spray system, the cloth does not require a pressurized squeezing of liquid, yet the cloth, such as a round drum cloth, can be continuously coated and impregnated with a prescribed amount of processing liquid on all of its surface without developing any specks, by adjusting the amount of the processing liquid sprayed from the nozzles. Therefore, similar advantages and special features as in the first example mentioned above can be obtained, and the intended object can be achieved.

Figure 4:
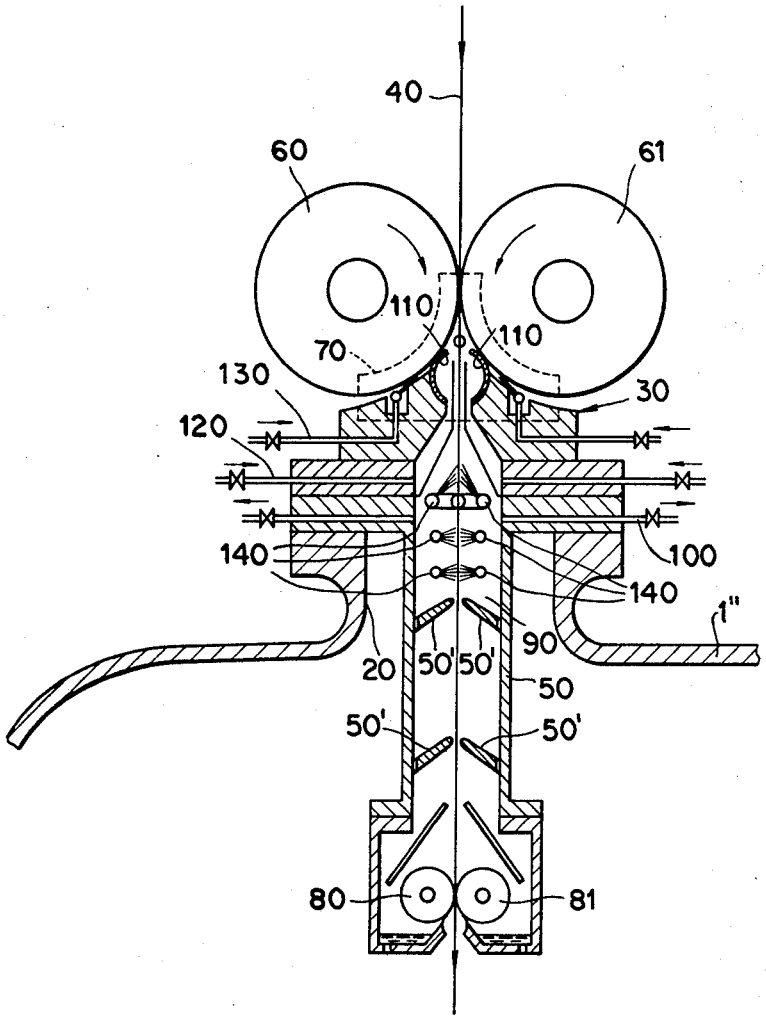
FIG. 4 is a vertical cross-sectional view of still another liquid processing apparatus embodying the present invention.

In the third example shown in FIG. 4, an inlet sealing mechanism (30) located at cloth inlet (20) to the high pressure steamer vessel (1'') allows a cloth (40) being processed to pass therethrough and has the function of preserving the high pressure heat within the vessel (1''). The sealing mechanism (30) includes a cloth passage (50) extending into the vessel (10), a pair of sealing rolls (60), (61) and end sealing plates (70) close the opening from the cloth passage (50) to outside of the steamer. A pair of gap rolls (80), (81) are positioned at the inner end of the cloth passage (50) which opens into the steamer and the gap rolls have a spacing of 0.5 to 0.2 mm therebetween. A pre-heating chamber (90) is formed within the cloth passage (50) and is subdivided by opposing valve seats (50') for reducing, in a multi-step manner, the temperature within the steamer vessel (1'') for example, 160° C., to a lower temperature of 130° C. to 60° C., and reduction exhaust tubes (100) are connected through the passage (50) to the pre-heating chamber (90). In addition to the components mentioned above, the sealing mechanism (30) includes elastic sealing plates (110), pressurized air blow in tubes (120), and pressurized water feeding tubes (130). However, since the structure of the sealing mechanism (30) is not a part of the present invention, a detailed description of its component parts and their function is omitted.

In FIG. 4, spray nozzles (140) direct processing liquid toward both surfaces of the cloth (40) are arranged in parallel within the pre-heating chamber (90). Therefore, the processing liquid is sprayed from spray nozzles (140) onto the cloth (40) after it passes through the pair of sealing rolls (60), (61), for coating and impregnating the cloth with the liquid, therefore, the surfaces of the sealing rolls (60), (61) will not be stained by processing liquid impregnated into the cloth. Further, the processing liquid will not be squeezed out by the pressure contacting force of the sealing rubber rolls, thus, an effective processing operation is afforded for the humid heat treatment of cloth impregnated with a prescribed amount of precessing liquid.

Further, as the spray nozzles (140) are provided within the pre-heating chamber (90) which is maintained at a temperature (for example a chamber temperature of about 80° C.) lower than the temperature (for example 160° C.) within the steamer vessel, the processing liquid is sprayed by the spray nozzles (the blowing pressure of the liquid is about 8 kg/cm$^2$) onto the cloth very effectively, yet the processing liquid sprayed on the cloth within the preheating chamber (90) is in a state containing the prescribed humid heat, thus there are the advantages that coating can be done without specks and processing liquid can be impregnated uniformly.

What is claimed is:

1. A method of continuously processing cloth with a liquid, such as a dyestuff, within a high pressure steamer vessel having a sealed inlet through which the cloth passes into the steamer vessel, comprising the steps of forming an enclosed spraying station within the steamer vessel adjacent the inlet, passing the cloth through the enclosed spraying station, controllably spraying the liquid onto the surface of the cloth only within the enclosed spraying station, removing the cloth from the spraying station and continuously conveying the cloth through the steamer vessel while exposing the cloth to high temperature and high humidity conditions for effecting the continuous treatment of the cloth by the spray liquid as it is conveyed through the steamer vessel, collecting the sprayed liquid within the enclosed spraying station after the spraying step and recirculating the collected liquid for further use in the spraying step, passing the cloth sprayed with the liquid through the steamer vessel along a zigzag path and periodically tensioning the cloth as it moves along the zigzag path, conveying the cloth through the spraying station and then through the steamer vessel while maintaining the cloth in the unpressed state, and dividing the enclosed spraying station into a plurality of serially arranged chambers and regulating the temperature within the chambers so that the temperature within the chambers is reduced in a stepwise manner to a level considerably below the temperature within the steamer vessel with the reduction in temperature taking place in the direction opposite to the direction of movement of the cloth through the chambers.

2. A method, as set forth in claim 1, including spraying the cloth in the first chamber within the closed spraying station in the direction of movement of the cloth through the spraying station.

3. A method, as set forth in claim 1, including spraying the opposite sides of the cloth as it moves through the spraying station.

* * * * *